US005215203A

United States Patent [19]

Malcolm

[11] Patent Number: 5,215,203

[45] Date of Patent: * Jun. 1, 1993

[54] BABY OR CHILD BOTTLE WITH HANDLES

[75] Inventor: Alexander R. Malcolm, Dudley, Mass.

[73] Assignee: Kinder-Grip International, Inc., West Greenwich, R.I.

[ * ] Notice: The portion of the term of this patent subsequent to Nov. 28, 2006 has been disclaimed.

[21] Appl. No.: 730,880

[22] Filed: Jul. 19, 1991

Related U.S. Application Data

[63] Continuation-in-part of Ser. No. 300,374, Jan. 23, 1989, Pat. No. Des. 320,859.

[51] Int. Cl.[5] ..... B65D 23/10

[52] U.S. Cl. ..... 215/100 A; 215/11.1; 215/1 C; 220/755; 220/752

[58] Field of Search ..... 215/100 A, 11.1, 1 C; 220/94 A, 755, 757; D9/401, 197, 199; D24/197, 199

[56] References Cited

U.S. PATENT DOCUMENTS

| | | | |
|---|---|---|---|
| D. 3,243 | 11/1868 | French . | |
| D. 63,326 | 11/1923 | Root . | |
| D. 82,083 | 9/1930 | Fuerst . | |
| D. 114,660 | 5/1939 | Kerckhoff . | |
| D. 121,192 | 6/1940 | McKnight . | |
| D. 145,758 | 10/1946 | Snyder, Jr. | D9/401 |
| D. 146,127 | 12/1946 | Billups . | |
| D. 149,506 | 5/1948 | Mayfield | D9/401 |
| D. 167,914 | 10/1952 | Taranton . | |
| D. 174,591 | 4/1955 | Parsell | D9/401 |
| D. 178,259 | 7/1956 | North | D9/401 |
| D. 189,373 | 11/1960 | Lerner . | |
| D. 193,216 | 7/1962 | Laudano . | |
| D. 198,404 | 6/1964 | Busch . | |
| D. 198,405 | 6/1964 | Recknagel . | |
| D. 214,147 | 5/1969 | Ritsi . | |
| D. 230,325 | 2/1974 | Sofro . | |
| D. 232,274 | 5/1894 | Davids | D9/401 |
| D. 259,096 | 5/1981 | Dittmeyer . | |
| D. 282,052 | 1/1986 | Beaver et al. . | |
| D. 283,920 | 5/1986 | Chen . | |
| D. 286,911 | 11/1986 | Campbell et al. . | |
| D. 287,337 | 12/1946 | Nickel . | |
| D. 320,455 | 10/1991 | Malcolm . | |
| D. 320,859 | 10/1991 | Malcolm . | |
| 954,564 | 4/1910 | Dunfee . | |
| 1,693,117 | 11/1928 | McDonnell . | |
| 1,713,858 | 5/1929 | Tevander | 220/309 X |
| 2,569,139 | 9/1951 | Abelson . | |
| 2,831,596 | 4/1958 | Eyles | 215/11.1 |
| 2,959,314 | 11/1960 | Sanchez . | |
| 2,986,296 | 5/1961 | Bannister et al. . | |
| 3,105,324 | 10/1963 | Friedman . | |
| 3,746,198 | 7/1973 | Howland . | |
| 4,557,392 | 12/1985 | Ryan et al. . | |
| 4,570,808 | 2/1986 | Campbell et al. | 220/94 A X |
| 4,700,856 | 10/1987 | Campbell et al. . | |
| 4,941,579 | 8/1990 | Lee | D24/199 X |

FOREIGN PATENT DOCUMENTS

| | | |
|---|---|---|
| 68395 | 4/1991 | Canada . |
| 69610 | 11/1991 | Canada . |
| 1551812 | 12/1968 | France . |

*Primary Examiner*—Allan N. Shoap
*Assistant Examiner*—Paul A. Schwarz
*Attorney, Agent, or Firm*—Ralph W. Selitto, Jr.

[57] ABSTRACT

A bottle includes at least two sets of handles, each set being adapted for gripping by an infant or a child. The handles are formed integrally with the bottle by a plurality of elongated, trough-like recesses provided in an outer surface of the bottle and extending along substantially the entire length thereof.

28 Claims, 4 Drawing Sheets

BABY OR CHILD BOTTLE WITH HANDLES

This application is a continuation-in-part of application Ser. No. 07/300,374, filed Jan. 23, 1989, now U.S. Pat. No. D320859, issued Oct. 15, 1991.

FIELD OF THE INVENTION

The present invention relates to bottles, and, more particularly, to bottles having integral handles which facilitate their use by an infant or a child.

BACKGROUND OF THE INVENTION

Most infants experience difficulty in attempting to grip a conventional feeding bottle because of the bottle's substantially smooth and generally cylindrical configuration. More particularly, the circumference of the bottle is usually too large for the baby to grip with his or her small hands. Thus, come feeding time, the baby cannot feed himself or herself with such a bottle unless he or she is assisted by an adult. The baby's need for assistance poses a problem not only for the baby, but also for the adult.

Attempts to overcome the problem described above have included baby bottles equipped with handles. For example, U.S. Pat. No. 4,570,808 discloses a baby bottle having a central opening traversing the intermediate portion of its body, thus forming two handles for the baby to grasp. By narrowing the intermediate portion of the body, the cross section of the handles is reduced, thus allowing the baby to grasp the handles with greater ease. In another embodiment, the cross section of the body is triangular with three handles being formed by concavities therein, sections, rather than by one central opening.

In U.S. Pat. No. 4,557,392, a baby bottle is disclosed which has two handles projecting from opposite sides of the bottle. Each of the handles includes a hand-grip portion spaced from the sidewall of the bottle so as to facilitate gripping by a baby.

Baby bottles with handles are much easier for a baby to hold than conventional baby bottles. However, even such non-conventional bottles have not, in the past, fully resolved the baby's problem of grasping them due to the fact that they must be placed in a particular orientation in order to be gripped by the baby (i.e., with at least two of the handles extending in a direction generally perpendicular to the baby's forward line of sight so that the baby can grip one handle with its left hand while simultaneously gripping the other handle with its right hand) and due to the further fact that many babies are incapable of orienting the bottles on their own. Because of the need to properly orient the known baby bottles with handles, such bottles still require adult assistance in many instances (i.e., in those instances in which the bottle is not properly preoriented relative to the baby). Without such preorientation, the known baby bottles with handles would be as difficult for the baby to grip as the conventional baby bottles without handles.

SUMMARY OF THE INVENTION

The present invention relates to a new and improved bottle which facilitates handling and use by infants and children. More particularly, the improvement involves providing the bottle with a body having at least two separate and distinct sets of handles, each set of handles being adapted for two-handed gripping by an infant or a child. By providing the body with multiple sets of handles, the bottle is always oriented in a position in which it is readily accessible for gripping by an infant or a child.

In one embodiment of the invention, the handles of each set are formed integrally with the bottle by a plurality of longitudinally-extending recesses provided in an outer surface of the bottle's body, each recess being deep enough to receive the fingers of an infant or a child. By making the recesses as long as possible, the handles formed thereby can be made to extend along substantially the entire length of the bottle, whereby the baby's use of the bottle is further facilitated by allowing the baby to grip the bottle at many different locations along the length thereof.

BRIEF DESCRIPTION OF THE DRAWINGS

For a better understanding of the present invention, reference is made to following description of five exemplary embodiments considered in conjunction with the accompanying drawings, in which.

DESCRIPTION OF THE EXEMPLARY EMBODIMENTS

Figure 1:
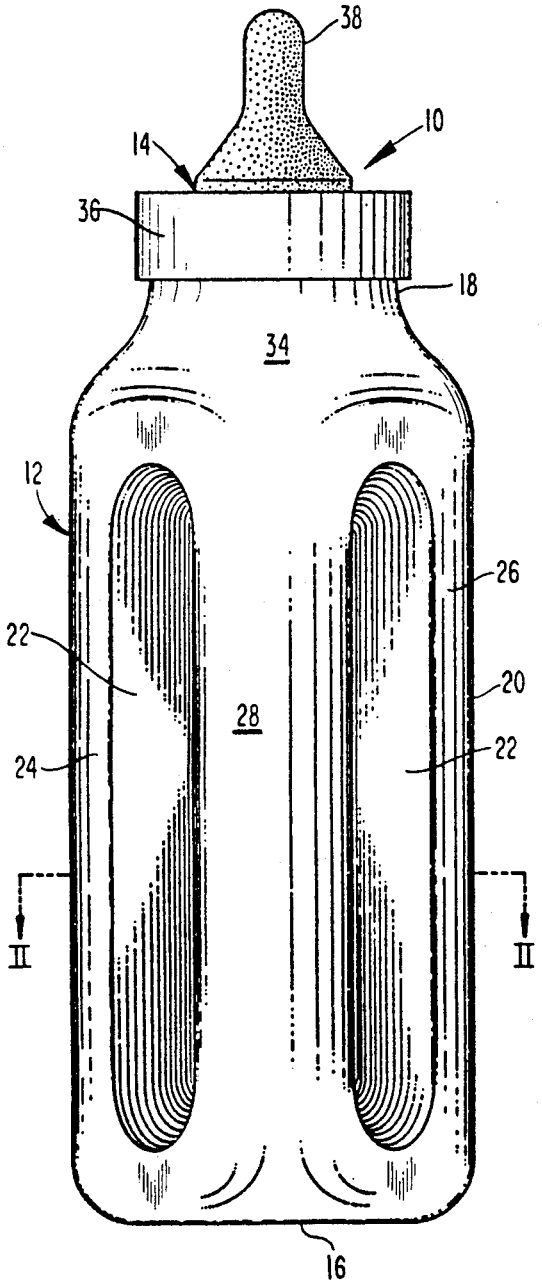
FIG. 1 is a front elevational view of a bottle constructed in accordance with a first exemplary embodiment of the present invention.

Although the present invention has utility as a bottle having many different and diverse end uses, it is especially suited for use as a bottle for infants and/or children. Accordingly, the present invention will be described hereinafter as a baby bottle and as a bottle adapted for use by children.

Referring to FIGS. 1–4, there is shown a baby bottle 10 having a body 12 and a nipple-type closure 14. The body 12, which can be made out of any suitable material such as plastic or glass, has a closed lower end 16, an open upper end 18 and a midsection 20.

Elongated, trough-like recesses 22 are formed in the midsection 20 and extend along substantially the entire length of the body 10. The recesses 22 give the midsection 20 a substantially uniform (i.e., symmetrical) transverse cross-sectional shape which assimilates a cruciform. The recesses 22 are deep enough to form a first set of lobe-shaped handles 24, 26 and a second set of lobe-shaped handles 28, 30.

Each of the handles 24, 26, 28, 30 is sized and shaped such that it can be readily grasped by the hand of a baby, with the baby's fingers being received in the recesses 22. Moreover, the handle 24 is located diametrically opposite the handle 26 so that the baby can grasp the handle 24 with one of its hands while grasping the handle 26 with its other hand. Similarly, the handle 28 is located diametrically opposite the handle 30 so that the baby can grasp the handle 28 with one of its hands while grasping the handle 30 with its other hand.

The handles 24, 26, 28, 30 facilitate the baby's use of the bottle 10 by always presenting the baby with at least one set of readily accessible handles (i.e., the handles 24, 26 or the handles 28, 30). In other words, regardless of its orientation relative to the baby, the bottle 10 can always be gripped by the baby without requiring any preorientation by the baby or by an adult. Because all of the handles 24, 26, 28, 30 extend along substantially the entire length of the body 12, the baby can grip the bottle 10 at many different locations along its length, thereby further facilitating the baby's use of the bottle 10.

Despite the presence of the recesses 22, the outer contour of the body 10 is smooth and continuous and without sharp edges which might injure the baby's delicate hands. The smooth and continuous outer contour of the body 12 also inhibits foreign matter from accumulating between the handles 24, 26, 28, 30, thereby facilitating the cleanliness of the bottle 10.

A base 32 is provided at the lower end 16 of the body 12. The base 32 is flat so that the bottle 10 can be easily stood in an upright position.

The upper end 18 of the body 12 is tapered to form a neck 34. External threads (not shown) are provided on the neck 34 so that the nipple-type closure 14 can be screwed on to and off of the bottle 10.

The nipple-type closure 14, which itself is conventional, includes a cap 36 and a rubber nipple 38. The cap 36 is provided with internal threads (not shown) which threadedly engage the external threads (not shown) on the neck 34 of the bottle 10. When the cap 36 is screwed on to the neck 34 of the bottle 10, the nipple-type closure 14 cooperates with the upper end 18 of the bottle 10 in a conventional manner to form a liquid-tight seal. Thus, when the bottle 10 is picked up by the baby and lifted to the baby's mouth, liquid will not leak from the bottle 10. The bottle 10 does not leak even when it is completely inverted by a baby who is feeding in a supine position.

Figure 2:
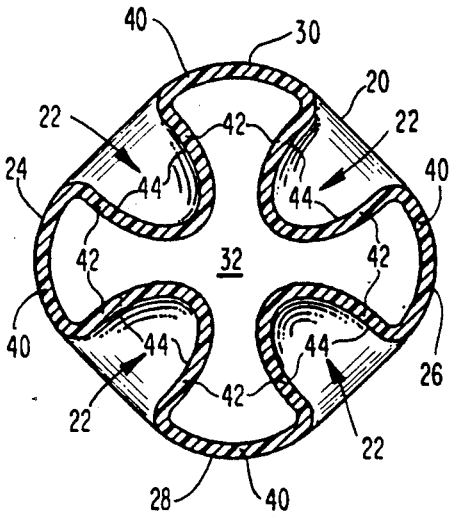
FIG. 2 is a cross-sectional view, taken along section line II—II in FIG. 1 and looking in the direction of the arrows, of the bottle illustrated in FIG. 1.
Figure 3:
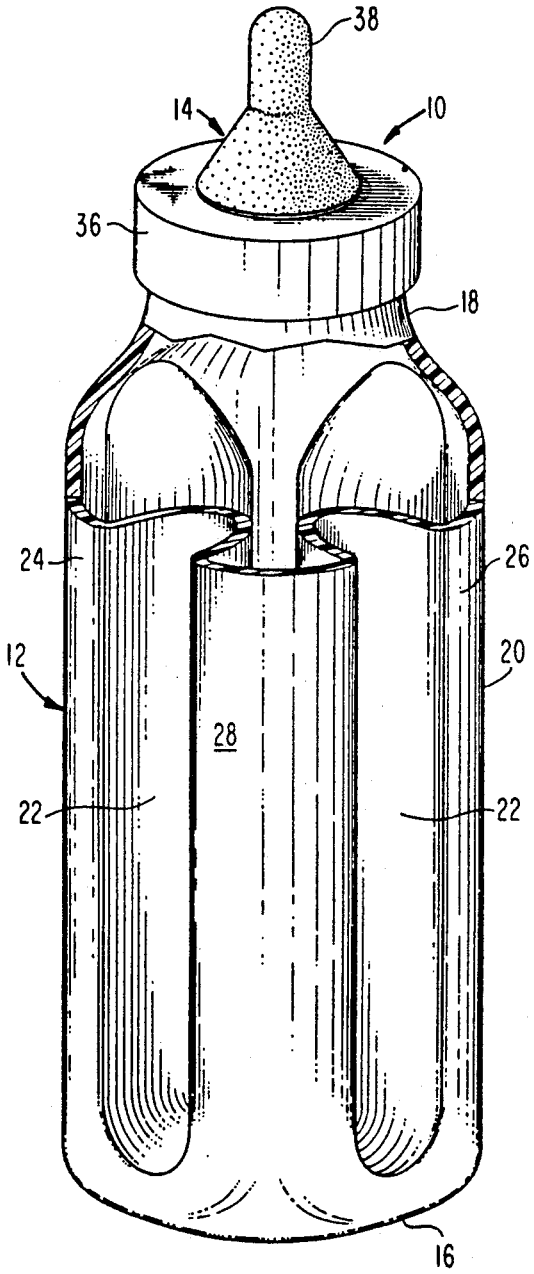
FIG. 3 is a perspective view of the bottle illustrated in FIG. 1, a portion of the bottle being broken away to facilitate consideration and discussion.
Figure 4:
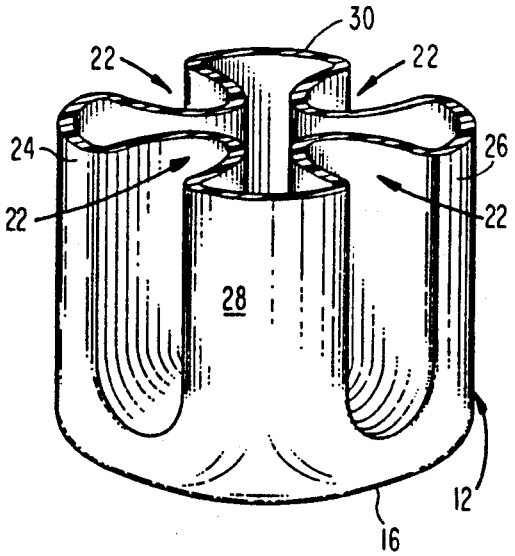
FIG. 4 is a perspective cross-sectional view of the bottle illustrated in FIG. 1, the cross section having been taken along section line II—II in FIG. 1 and looking in the direction of the arrows.

Referring now to FIG. 2, the handles 24, 26, 28, 30 extend radially inward, toward a central longitudinal axis of the body 12. Each of the handles 24, 26, 28, 30 has a front wall 40, located at the periphery of the body 12, and a pair of sidewalls 42 extending from opposite ends of the front wall 40 toward the central longitudinal axis of the body 12 and converging toward each other as they approach the axis. The nondivergence of the sidewalls 42 enhances an infant's natural tendency to curl his or her hand into a C-shaped gripping position around the handles 24, 26, 28, 30 (i.e., with the tip of the fingers pointing towards the opposing thumb). Such a C-shaped gripping position may be further enhanced by providing each of the non-diverging sidewalls 42 with an outer surface 44 which is concave relative to an infant who is gripping the body 12.

Four other exemplary embodiments of a bottle constructed in accordance with the present invention are illustrated in FIGS. 5, 6, 7 and 8, respectively. Elements illustrated in FIGS. 5, 6, 7, and 8 which correspond to the elements described above with respect to FIGS. 1–4 have been designated by corresponding reference numerals increased by one hundred, two hundred, three hundred and four hundred, respectively. The embodiments of FIGS. 5–8 are designed for use in the same manner as the embodiment of FIGS. 1–4 unless otherwise stated.

Figure 5:
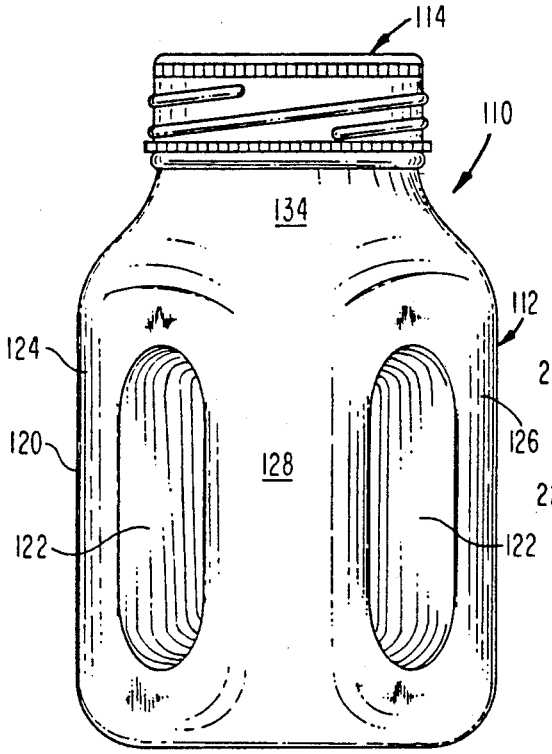
FIG. 5 is a front elevational view of a bottle constructed in accordance with a second exemplary embodiment of the present invention.

Referring now to FIG. 5, a body 112 of a bottle 110 has a midsection 120 which is provided with recesses 122 (only two of which are visible in FIG. 5) and handles 124, 126, 128, 130 (only three of which are visible in FIG. 5). The recesses 122 are sized and shape so as to give the midsection 120 the same basic transverse cross-sectional shape as the midsection 20 of the bottle 10. However, because the bottle 110 is intended primarily for use by non-infant children, rather than by babies, minor dimensional changes may be made in its transverse cross-sectional shape in order to accommodate the larger hands of such children. In view of its intended use, the bottle 110 is provided with a large diameter, internally threaded closure 114 (i.e., one which resembles those commonly found on juice containers and the like), instead of the nipple-type closure 14 of the bottle 10. The closure 114 threadedly engages a short, wide-mouth neck 134 of the bottle 110.

Figure 6:
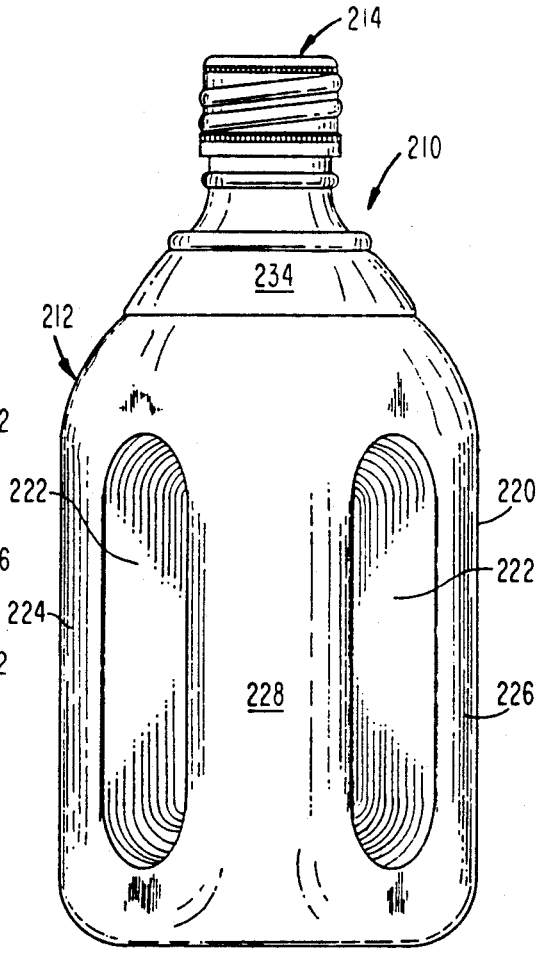
FIG. 6 is a front elevational view of a bottle constructed in accordance with a third exemplary embodiment of the present invention.

Referring now to FIG. 6, a body 212 of a bottle 210 has a midsection 220 which is provided with recesses 222 (only two of which are visible in FIG. 6) and handles 224, 226, 228, 230 (only three of which are visible in FIG. 6). The recesses 222 are sized and shaped so as to give the midsection 220 the same basic transverse cross-sectional shape as the midsection 20 of the bottle 10. However, because the bottle 210 is intended primarily for use by non-infant children, rather than by babies, minor dimensional changes may be made in its transverse cross-sectional shape in order to accommodate the larger hands of such children. In view of its intended use, the bottle 210 is provided with a small diameter, internally-threaded closure 214 (i.e., one which resembles those commonly found on soda bottles and the like), instead of the nipple-type closure 14 of the bottle 10. The closure 214 threadedly engages an elongated, narrow-mouth neck 234 of the bottle 210.

Figure 7:
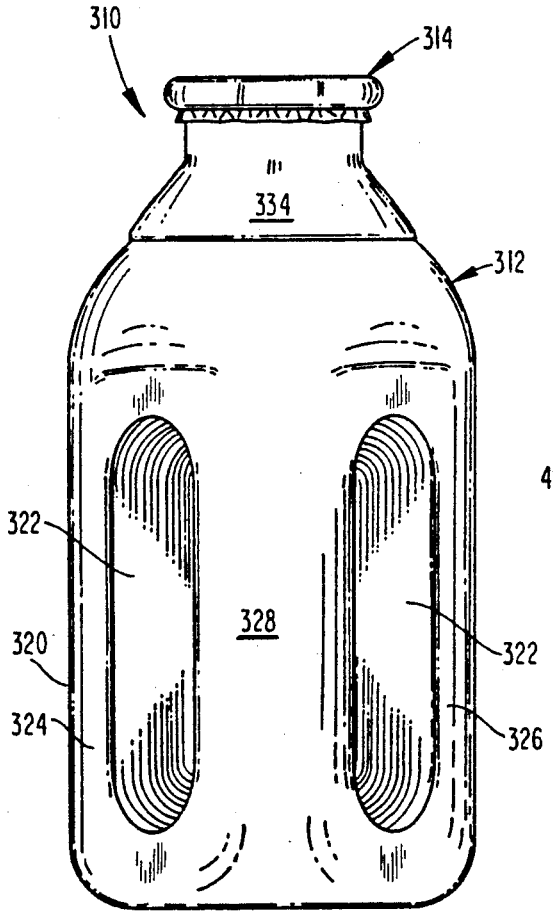
FIG. 7 is a front elevational view of a bottle constructed in accordance with a fourth exemplary embodiment of the present invention.

Referring now to FIG. 7, a body 312 of a bottle 310 has a midsection 320 which is provided with recesses 322 (only two of which are visible in FIG. 7) and handles 324, 326, 328, 330 (only three of which are visible in FIG. 7). The recesses 322 are sized and shaped so as to give the midsection 320 the same basic transverse cross-sectional shape as the midsection 20 of the bottle 10. However, because the bottle 310 is intended primarily for use by non-infant children, rather than by babies, minor dimensional changes may be made in its transverse cross-sectional shape in order to accommodate the larger hands of such children. In view of its intended use, the bottle 310 is provided with a crimp-type closure 314, instead of the nipple-type closure 14 of the bottle 10. The closure 314 is crimped around a non-threaded neck 334 of the bottle 310.

Figure 8:
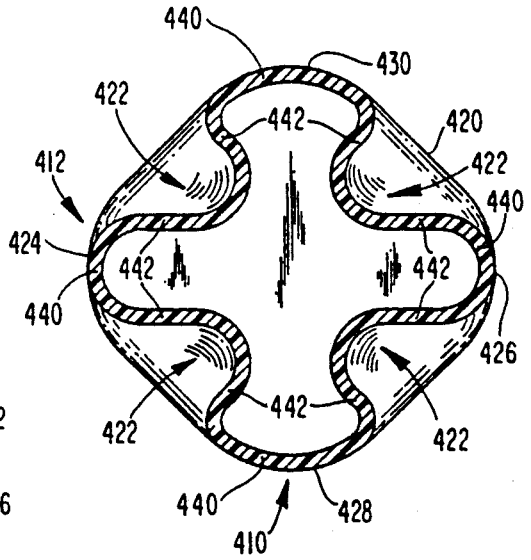
FIG. 8 is a cross-sectional view, similar to that of FIG. 2, of a bottle constructed in accordance with a fifth exemplary embodiment of the present invention.

Referring now to FIG. 8, a body 412 of a bottle 410 has a midsection 420 provided with recesses 422 and handles 424, 426, 428, 430, which cooperate with the recesses 422 to give the midsection a non-uniform (i.e., asymmetrical) transverse cross-sectional shape. Unlike the handles 24, 26, 28, 30 of the bottle 10, the handles 424, 426, 428, 430 of the bottle 410 are not identical to each other. Rather, the handle 424 is identical to the handle 426 and the handle 428 is identical to the handle 430. While the handles 428, 430 have curved sides, the handles 424, 426 are straight-sided so as to facilitate the molding of the bottle 410 by eliminating the need to provide the required molds with side actions or cam actions. When the bottle 410 is so molded, the handles 424, 426, 428, 430 would be formed monolithically with the body 412.

Referring still to FIG. 8, the handles 424, 426, 428, 430 extend radially inward, toward a central longitudinal axis of the body 412. Each of the handles 424, 426, 428, 430 has a front wall 440, located at the periphery of the body 412, and a pair of sidewalls 442 extending from opposite ends of the front wall 440 toward the central longitudinal axis of the body 412. While the sidewalls 442 of the handles 428, 430 converge toward each other as they approach the central longitudinal axis of the body 412, the sidewalls 442 of the handles 424, 426 are parallel to each other.

It will be understood that the embodiments described herein are merely exemplary and that a person skilled in the art may make many variations and modifications without departing from the spirit and scope of the present invention. All such variations and modifications are intended to be included within the scope of the invention as defined in the appended claims.

What is claimed is:

1. A bottle adapted for use by an infant or a child, comprising a baby; a first pair of handles provided on said body, said handles of said first pair of handles being arranged generally opposite each other and being sized and shaped so as to be grippable by an infant or a child when said body is oriented in a first position relative to the infant or the child; a second pair of handles provided on said body, said handles of said second pair of handles being arranged generally opposite each other and being sized and shaped so as to be grippable by an infant or a child when said body is oriented in a second position relative to the infant or the child, whereby said bottle can be placed in a number of substantially different positions and still be accessible for gripping by the infant or the child, one handle of said first pair of handles being separated from one handle of said second set of handles by a first recess formed in said body of said bottle and from the other handle of said second set of handles by a second recess formed in said body of said bottle, the other handle of said first pair of handles being separated from said one handle of said second set of handles by a third recess formed in said body of said bottle and from said other handle of said second set of handles by a fourth recess formed in said body of said bottle, said one handle of said first pair of handles being substantially identical in size and shape to said other handle of said first pair of handles, said one handle of said second pair of handles being substantially identical in size and shape to said other handle of said second pair of handles, and said handles of said first pair of handles being substantially different in size and shape from said handles of said second pair of handles.

2. A bottle according to claim 1, wherein said handles of at least one of said first and second pairs of handles have straight sidewalls.

3. A bottle according to claim 2, wherein said handles of said first pair of handles have straight sidewalls and said handles of said second pair of handles have curved sidewalls.

4. A bottle adapted for use by an infant or a child, comprising a body; a first pair of handles provided on said body, said handles of said first pair of handles being arranged generally opposite each other and being sized and shaped so as to be grippable by the infant or the child when said body is oriented in a first position relative to the infant or the child; and a second pair of handles provided on said body, said handles of said second pair of handles being arranged generally opposite each other and being sized and shaped so as to be grippable by the infant or the child when said body is oriented in a second position relative to the infant or the child, whereby said bottle can be placed in a number of substantially different positions and still be accessible for gripping by the infant or the child, each of said handles including a front wall, which defines a periphery of said body, and a pair of spaced, inwardly directed, non-diverging sidewalls extending from opposite ends of said front wall toward a central longitudinal axis of said body, whereby said front wall and said sidewalls of each handle cooperate to provide each of said handles with a shape which enhances the infant's or child's natural tendency to curl his or her hand into a generally C-shaped gripping position.

5. A bottle according to claim 4, wherein said first and second pairs of handles are formed monolithically with said body of said bottle.

6. A bottle according to claim 4, wherein each handle of said first and second pairs of handles extends along substantially the entire length of said body of said bottle.

7. A bottle according to claim 4, wherein one handle of said first pair of handles is separated from one handle of said second set of handles by a first recess formed in said body of said bottle and from the other handle of said second set of handles by a second recess formed in said body of said bottle, and wherein the other handle of said first pair of handles is separated from said one handle of said second set of handles by a third recess formed in said body of said bottle and from said other handle of said second set of handles by a fourth recess formed in said body of said bottle.

8. A bottle according to claim 7, wherein each of said first, second, third and fourth recesses is sized and shaped so as to receive the fingers of an infant or a child.

9. A bottle according to claim 8, wherein each of said first, second, third, and fourth recesses extends along substantially the entire length of said body of said bottle.

10. A bottle according to claim 7, wherein said handles cooperate with said recesses to give said body of said bottle a transverse cross-sectional shape which assimilates a cruciform.

11. A bottle according to claim 7, wherein said one handle of said first pair of handles is substantially identical in size and shape to said other handle of said first pair of handles.

12. A bottle according to claim 11, wherein said one handle of said second pair of handles is substantially identical in size and shape to said other handle of said second pair of handles.

13. A bottle according to claim 12, wherein said handles of said first pair of handles are substantially identical in size and shape to said handles of said second pair of handles.

14. A bottle according to claim 12, wherein said handles of said first pair of handles are substantially different in size and shape from said handles of said second pair of handles.

15. A bottle according to claim 14, wherein said sidewalls of said handles of said first or second pair of handles are straight.

16. A bottle according to claim 15, wherein said sidewalls of said handles of said first pair of handles are straight and said sidewalls of said handles of said second pair of handles are concave relative to the infant or the child who is gripping said body.

17. A bottle according to claim 4, wherein said handles of said first pair of handles are arranged diametrically opposite each other, and wherein said handles of said second pair of handles are arranged diametrically opposite each other.

18. A bottle according to claim 4, wherein said body has a closed end and an open end.

19. A bottle according to claim 18, further comprising a closure threadedly attached to said open end of said body.

20. A bottle according to claim 19, wherein said closure includes a nipple, whereby said bottle may be used by babies.

21. A bottle according to claim 18, further comprising a closure crimped to said open end of said body.

22. A bottle according to claim 4, wherein said body of said bottle is made out of plastic.

23. A bottle according to claim 4, wherein said body of said bottle is made out of glass.

24. A bottle according to claim 4, wherein each of said sidewalls has an outer end connected to said front wall of said body and an inner end opposite to said outer end, said sidewalls of each of said handles converging toward each other between said outer and inner ends thereof such that the distance between said outer ends is greater than the distance between said inner ends.

25. A bottle according to claim 24, wherein each of said sidewalls of each of said handles has an outer surface which is concave relative to the infant or the child who is gripping said body.

26. A bottle according to claim 4, wherein each of said sidewalls of each of said handles has an outer surface which is concave relative to the infant or the child who is gripping said body.

27. A bottle according to claim 4, wherein said sidewalls of said handles of said first or second pair of handles are straight.

28. A bottle according to claim 4, wherein each of said handles is lobe-shaped.

* * * * *